US005401032A

United States Patent [19]

Barnhart et al.

[11] Patent Number: 5,401,032

[45] Date of Patent: Mar. 28, 1995

[54] MYSTERY PUZZLE GAME

[75] Inventors: Thomas L. Barnhart; Frank M. Smith, both of Atlanta, Ga.

[73] Assignee: Cassette Productions Unlimited, Inc., Irvine, Calif.

[21] Appl. No.: 131,488

[22] Filed: Oct. 4, 1993

[51] Int. Cl.[6] ..... A63F 1/00

[52] U.S. Cl. ..... 273/293; 273/306

[58] Field of Search ..... 273/292, 293, 296, 299, 273/300, 306, 308

[56] References Cited

U.S. PATENT DOCUMENTS

| | | | |
|---|---|---|---|
| 979,642 | 12/1910 | Bumstead | 273/299 |
| 999,913 | 8/1911 | Todd | 273/300 |
| 1,600,108 | 9/1926 | Gell | 273/300 |
| 2,019,732 | 11/1935 | Roland | 273/293 |
| 2,099,611 | 11/1937 | Levoy | 273/299 |
| 3,068,010 | 12/1962 | Hagopian | 273/295 |
| 3,081,088 | 3/1963 | Kast | 273/293 |
| 3,327,406 | 6/1967 | Baker | 273/293 X |
| 3,734,509 | 5/1973 | Glass et al. | 273/293 X |
| 4,050,698 | 9/1977 | Brown | 273/308 X |
| 5,318,306 | 6/1994 | Levin | 273/308 X |

FOREIGN PATENT DOCUMENTS

| | | | |
|---|---|---|---|
| 1203382 | 8/1970 | United Kingdom | 273/293 |
| 1396611 | 6/1975 | United Kingdom | 273/296 |

*Primary Examiner*—William E. Stoll

*Attorney, Agent, or Firm*—Christie, Parker & Hale

[57] ABSTRACT

A game having a number of cards on which a story is written. Certain elements of the story are obscured by chromatic camouflage. A decoder having a chromatic filter may be used to view the obscured elements.

15 Claims, 13 Drawing Sheets

Fig. 2b

2

THE MYSTERY OF MONSTER MANOR

2

Further down the hall the trio found a dusty old room full of scientific stuff. "Must be Doctor Franken's lab," said Skippy. They saw an old 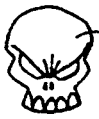 48 on a table. "Might be Doctor Franken," said Waggy. "Or...like...the monster!" said Skippy. "Veah!" Woofy said nervously. Skippy lit a 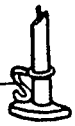 50 and they saw a giant platform covered with a big cloth. Woofy jumped back and bumped into a 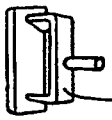 52. Sparks flew! The table shook! The big cloth fell off the table and there was

...THE MONSTER! 76

Fig. 2C

3

3 THE MYSTERY OF MONSTER MANOR

Woofy-Dog, Skippy and Waggy-Pup tried to run but the door slammed shut and locked. Skippy looked for something to break the door open. "How about this?" 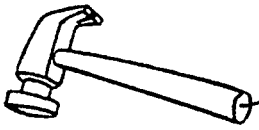 54 said Waggy. "Vook, Vaggy!" said Woofy holding up a 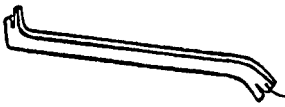 56. "Yoinks! Let's forget the secret formula for making gold and split!" yelled Skippy. They all turned to run away from the monster and tripped over a great big 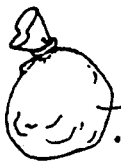 58.

Fig. 2d

4

THE MYSTERY OF MONSTER MANOR

4

Woofy-Dog, Skippy and Waggy-Pup lay on the floor. The monster walked toward them. Waggy threw the hammer across the floor and the monster tripped on it. Then Waggy picked up an old 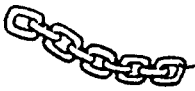 60 and wrapped it around the monster's legs. The 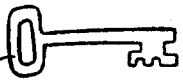 62 to the door fell from its hand, and a mask fell off its head. It wasn't a monster after all, just a thief who wanted to steal the big sack.

80 WHY?

Can you guess what was inside the sack? 82

Fig. 3a

1

THE MYSTERY OF MONSTER MANOR

1

Woofy-Dog, Skippy and Waggy-Pup are trying to solve the mystery of Monster Manor. They have heard that the mysterious Doctor Franken can turn things into gold! As they entered the Manor, Woofy saw a big [illegible] and cried "Vi wanna go home!" "Not until we solve the mystery," said Waggy. "You're not scared are you Uncle Woofy?" "Vah-un," answered Woofy. Just then a big [illegible] dropped on his head. "Viii!" screamed Woofy. "Chill out Woof and check this out," said Skippy. [illegible] "Yoinks!" he said, "A clue...C'mon!"

40

40

64

41

40

Fig. 3b

2

THE MYSTERY OF MONSTER MANOR

2

Further down the hall the trio found a dusty old room full of scientific stuff. "Must be Doctor Franken's lab," said Skippy. They saw an old [illegible] on a table. "Might be Doctor Franken," said Waggy. "Or...like...the monster!" said Skippy. "Veah!" Woofy said nervously. Skippy lit a [illegible] and they saw a giant platform covered with a big cloth. Woofy jumped back and bumped into a [illegible]. Sparks flew! The table shook! The big cloth fell off the table and there was

...THE MONSTER!

Fig. 3C

3

3 THE MYSTERY OF MONSTER MANOR

Woofy-Dog, Skippy and Waggy-Pup tried to run but the door slammed shut and locked. Skippy looked for something to break the door open. "How about this?" said Waggy. "Vook, Vaggy!" said Woofy holding up a "Yoinks! Let's forget the secret formula for making gold and split!" yelled Skippy. They all turned to run away from the monster and tripped over a great big

Fig. 3d

4

THE MYSTERY OF MONSTER MANOR

4

Woofy-Dog, Skippy and Waggy-Pup lay on the floor. The monster walked toward them. Waggy threw the hammer across the floor and the monster tripped on it. Then Waggy picked up an old 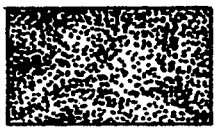 and wrapped it around the monster's legs. The 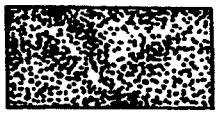 to the door fell from its hand, and a mask fell off its head. It wasn't a monster after all, just a thief who wanted to steal the big sack.

80 WHY?

82 Can you guess what was inside the sack?

5

THE MYSTERY OF MONSTER MANOR

Answers:

1. RAT; SPIDER; FOOTPRINTS
2. SKULL; CANDLESTICK; ELECTRIC SWITCH
3. HAMMER; CROWBAR; SACK
4. CHAIN; KEY

THE MYSTERY OF MONSTER MANOR:

*Dr. Franken's formula WORKED...*
*The Sack Was Filled With GOLD!*

Fig. 5b

INSTRUCTIONS

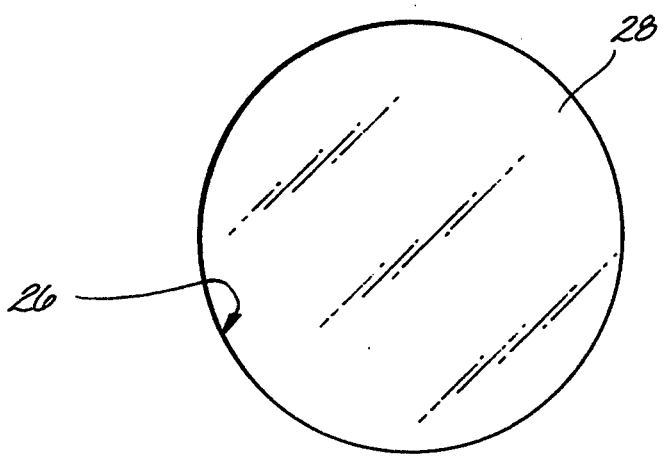

6

The Woofy-Dog Mystery Puzzle Card Pack contains 6 cards: 4 numbered story cards; 1 red circle decoder card; 1 story answer card.

On each story card two or three picture clues are hidden from view. To find the hidden clues, read the story and then place the red circle of the decoder card over the blank spaces in the story and pictures of the clues will appear. Remember the pictures.

When you have read all the story cards, try to solve the mystery. Look at the answer card if you need help. Then turn the cards over and match them up with the picture side of the answer card to make a color puzzle. The pictures you remember from the story cards are hidden in the color puzzle. Find the pictures again. You can peek at the answer card if you need help.

32

MYSTERY PUZZLE GAME

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

BACKGROUND OF THE INVENTION

The invention pertains to games, puzzles and toys and more particularly to children's novelty puzzles which involve solving a mystery or story.

There are a wide variety of children's games, puzzles, toys and other novelties which primarily consist of cards. In addition to the most basic sports trading cards, there have been movie trading cards, the front faces of which are pictures of individual characters from the movie and the back faces of which have a portion of a scene from the movie or other illustration. On such cards, the user must purchase and collect the cards until he has all the cards that are required to assemble that scene or illustration.

There are, additionally, a variety of optical illusions and devices formed using different colored markings so that when viewed in a particular way or through a particular filter such as a color filter a certain image is perceived. Similar marking techniques have been used to create tests for various forms of color blindness.

One technique involves the use of a colored transparent sheet which acts as a filter tending to prevent the transmission of light rays of substantially different color than the filter. By example, if the primary color red is used for the filter it will absorb light of the other primary colors blue and green. Accordingly, objects which are otherwise blue or green will appear black (the absence of light transmission) whereas red objects will remain red and white objects will also be seen as red as the blue and green components of the white light are absorbed by the filter. Accordingly, on a white background, an image in blue may be surrounded and camouflaged by red markings so as to appear substantially illegible when viewed with the naked eye. When viewed through a red filter, however, it can be seen as a black image on a solid red background. It is further possible to use similar techniques whereby different images appear when the item is viewed through different primary or secondary color filters.

The basic technique has been used to hide clues or answers used with board games.

SUMMARY OF THE INVENTION

One embodiment of the invention has a number of game cards. On one face of each of the cards, a story is written in which a number of the story elements are obscured by chromatic camouflage. A decoder which has a chromatic filter is used to view the obscured elements. One of the cards is an answer card bearing a key to the obscured story elements and an answer to a mystery contained in the story. On the other face of each card there is borne in combination an illustration of a scene from the story. The entire game is contained in a film package.

BRIEF DESCRIPTION OF THE DRAWINGS

The features of an exemplary puzzle in a preferred embodiment of the best mode contemplated in carrying out the invention are illustrated in the drawings, in which:

FIG. 2*b* is a view of the back face of a second game card according to principles of the invention with hidden elements shown revealed;

FIG. 2*c* is a view of the back face of a third game card according to principles of the invention with hidden elements shown revealed;

FIG. 2*d* is a view of the back face of a fourth game card according to principles of the invention with hidden elements shown revealed;

FIG. 3*a* is a view of the back face of the game card of FIG. 2*a* with hidden elements shown camouflaged;

FIG. 3*b* is a view of the back face of the game card of FIG. 2*b* with hidden elements shown camouflaged;

FIG. 3*c* is a view of the back face of the game card of FIG. 2*c* with hidden elements shown camouflaged;

FIG. 3*d* is a view of the back face of a the game card of FIG. 2*d* with hidden elements shown camouflaged;

FIG. 5*b* is a view of the back of a decoder card according to principles of the invention;

DETAILED DESCRIPTION

Figure 6:
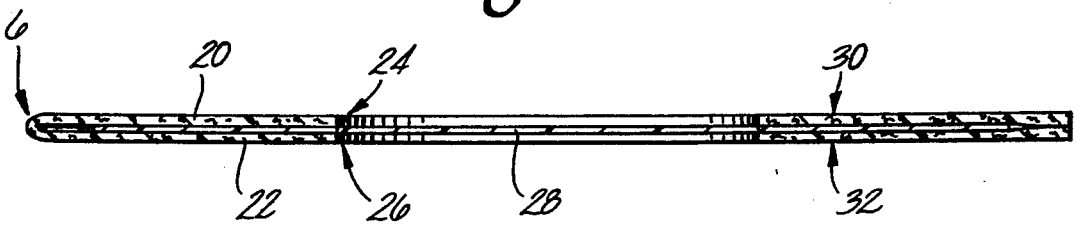
FIG. 6 is a view of the decoder card of FIGS. 5*a* and 5*b* partially in cross-section.
Figure 7:
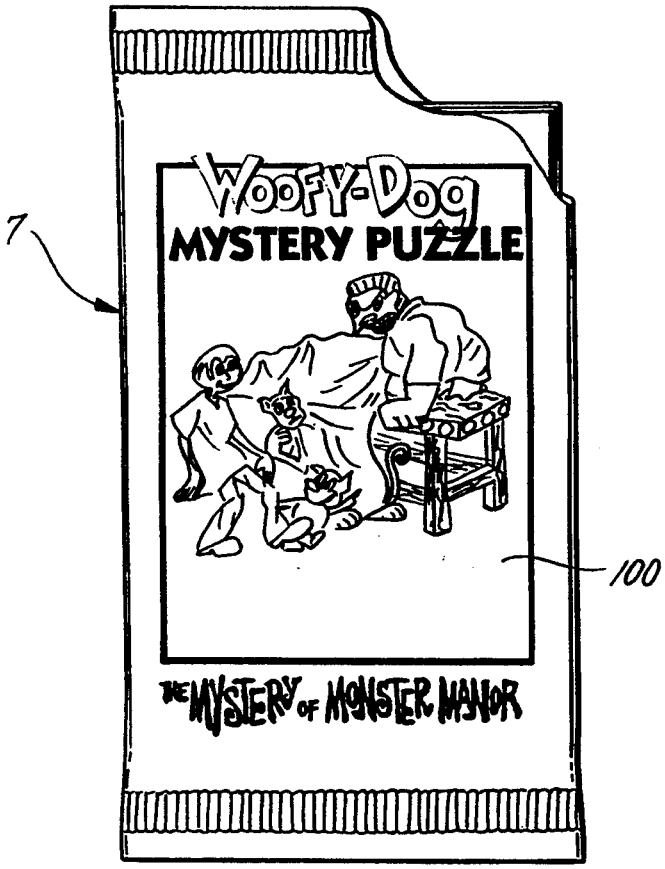
FIG. 7 is a cutaway view of a game package according to principles of the invention.

A preferred embodiment of a puzzle according to the present invention has first through fifth game cards one-5, respectively (FIGS. 2*a*–2*d*, 3*a*–3*d* and 4), a decoder card 6 (FIGS. 5*a*–6) and a wrapper 7 (FIG. 7).

An exemplary story, entitled "The Mystery of Monster Manor" (© 1993, Cassette Productions Unlimited, Inc.), is written on the back faces of game cards 1–4 as shown in FIGS. 2*a*–2*d* and 3*a*–3*d*. Each of these four game cards bears its identifying number in the upper left corner and has a heading corresponding to the title of the story.

Figure 5A:
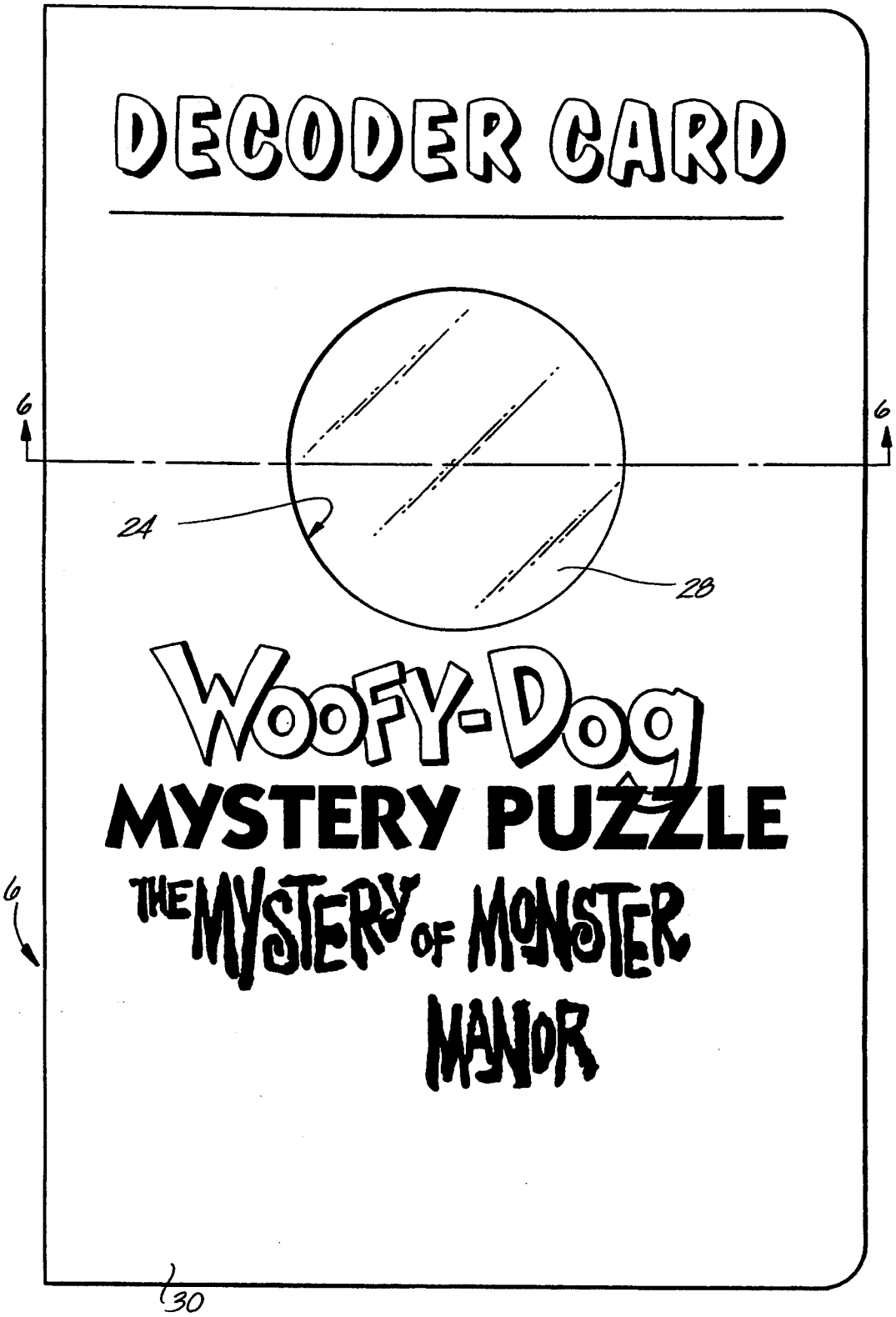
FIG. 5*a* is a view of the front of a decoder card according to principles of the invention.

As shown in FIGS. 5*a*–6, the decoder card 6 comprises a sheet of cardboard folded to form first and second layers 20 and 22, respectively. The first and second layers have circular windows 24 and 26, respectively, concentrically aligned with each other. A chromatic filter 28 is secured between the first and second layers and spans the windows.

In the illustrated embodiment, the decoder card measures 2.5 inches in width and 3.75 inches in length and is formed of 12 point stock having an aqueous coding on its outer faces 30 and 32 (front and back, respectively). The windows are approximately 1 inch in diameter. Further, in the preferred embodiment the chromatic filter is formed of 0.00125 inch thick transparent red polyester film, such as sold by Du Pont Co under the trademark MYLAR. The film is cut to approximately 2.25 inches square and glued between the first and second layers of the decoder card.

As shown in FIGS. *3a–3d*, a plurality of elements of the story are obscured by chromatic camouflage 40 on the game cards 1–4. In the preferred embodiment of the puzzle, the chromatic camouflage comprises red markings 41 on the back faces of cards 1–4. The camouflage is formed from a mezzotint screen printed on the card. Beneath the mezzotint, the elements are drawn in blue ink in the form of illustrations. A preferred ink is known in the art as "non repro blue." As shown in FIGS. *2a–2d*, revealed through the camouflage, the exemplary elements are a rat 42, a spider 44, footprints 46, a skull 48, a candlestick 50, an electric switch 52, a hammer 54, a crowbar 56, a sack 58, a chain 60 and a key 62.

When those hidden elements are viewed through the chromatic filter 28, the red light reflected by the red chromatic camouflage is substantially unaffected. Colors other than the red will not pass as freely through the filter and therefore the white portions 64 interspersed with the chromatic camouflage 40 will be seen as red, when viewed through the chromatic filter 28, substantially indistinguishable from the camouflage. As blue light does not readily pass through the chromatic filter, the elements 40–62 are seen through the filter as dark, almost black, in contrast with the surrounding red and therefore will be more legible than when viewed without the aid of the filter. Accordingly, the elements are seen substantially as shown in FIGS. *2a–2d*.

In the exemplary embodiment, the decoder card has on its back face 32 the heading "INSTRUCTIONS" above the window and the following instructional text below the window:

The Woofy-Dog Mystery Puzzle Card Pack contains 6 cards: 4 numbered story cards; 1 red circle decoder card; 1 story answer card.

On each story card two or three picture clues are hidden from view. To find the hidden clues, read the story and then place the red circle of the decoder card over the blank spaces in the story and pictures of the clues will appear. Remember the pictures.

When you have read all the story cards, try to solve the mystery. Look at the answer card if you need help. Then turn the cards over and match them up with the picture side of the answer card to make a color puzzle. The pictures you remember from the story cards are hidden in the color puzzle. Find the pictures again. You can peek at the answer card if you need help.

Accordingly, the user, typically a child, may read through the story, card by card, using the decoder to reveal the hidden elements.

In this exemplary game, as shown in FIG. *2a*, the back of the first card 1 reads as follows with parentheticals of all-caps text indicating a hidden illustration:

Woofy-Dog, Skippy and Waggy-Pup are tying to solve the mystery of Monster Manor. They have heard that the mysterious Doctor Franken can turn things into gold! As they entered the Manor, Woofy saw a big (RAT) and cried "Vi wanna go home!" "Not until we solve the mystery," said Waggy. "You're not scared are you Uncle Woofy?" "Vah-un," answered Woofy. Just then a big (SPIDER) dropped on his head. "Viii!" screamed Woofy. "Chill out Woof and check this out," said Skippy. (FOOTPRINTS) "Yoinks!" he said, "A clue . . . C'mon!"

As shown in FIG. *2b*, the back of the second card 2 reads:

Further down the hall the trio found a dusty old room full of scientific stuff. "Must be Doctor Franken's lab," said Skippy. They saw an old (SKULL) on a table. "Might be Doctor Franken," said Waggy. "Or . . . Like . . . the Monster!" said Skippy. "Veah!" Woofy said nervously. Skippy lit a (CANDLESTICK) and they saw a giant platform covered with a big cloth. Woofy jumped back and bumped into a (ELECTRIC SWITCH). Sparks flew! The table shook! The big cloth fell off the table and there was . . . THE MONSTER!

As shown in FIG. *2c*, the back of the third card 3 reads:

Woofy-Dog, Skippy and Waggy-Pup tried to run but the door slammed shut and locked. Skippy looked for something to break the door open. "How about this?" (HAMMER) said Waggy. "Vook, Vaggy!" said Woofy holding up a (CROWBAR). "Yoinks! Let's forget the secret formula for making gold and split!" yelled Skippy. They all turned to run away from the monster and tripped over a great big (SACK).

As shown in FIG. *2d*, the back of the fourth card 4 reads:

Woofy-Dog, Skippy and Waggy-Pup lay on the floor. The monster walked toward them. Waggy threw the hammer across the floor and the monster tripped on it. Then Waggy picked up an old (CHAIN) and wrapped it around the monster's legs. The (KEY) to the door fell from its hand, and a mask fell of its head. It wasn't a monster after all, just a thief who wanted to steal the big sack.

WHY?

Can you guess what was inside the sack?

The story features the names 70, 72, 74 and 76 of various of its characters and ends with one or more questions 80, 82 directed to a mystery outlined in the story. The elements 40–62 may be clues to that mystery. It is an aspect of the puzzle to solve the mystery.

Figure 4:
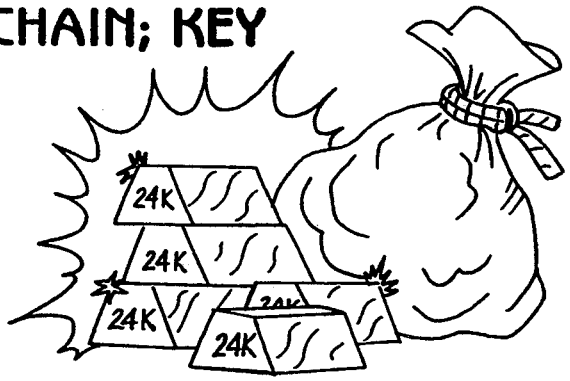
FIG. 4 is a view of the back face of a fifth game card according to principles of the invention.

As shown in FIG. 4, the back of the fifth or answer card 5 also bears a heading corresponding to the title of the story and additionally bears a key to the hidden elements 40–62 of cards 1–4 listed card by card, i.e.:

ANSWERS:

1. RAT; SPIDER; FOOTPRINTS
2. SKULL; CANDLESTICK; ELECTRIC SWITCH
3. HAMMER; CROWBAR; SACK
4. CHAIN; KEY

Below the key, the card bears the answer or solution to the mystery in the form of an illustration and text. In the exemplary embodiment, the answer comprises an illustration of five gold bars and the aforementioned sack along with the text:

THE MYSTERY OF MONSTER MANOR:
Dr. Franken's formula WORKED . . .
The Sack Was Filled With GOLD!

Figure 1:
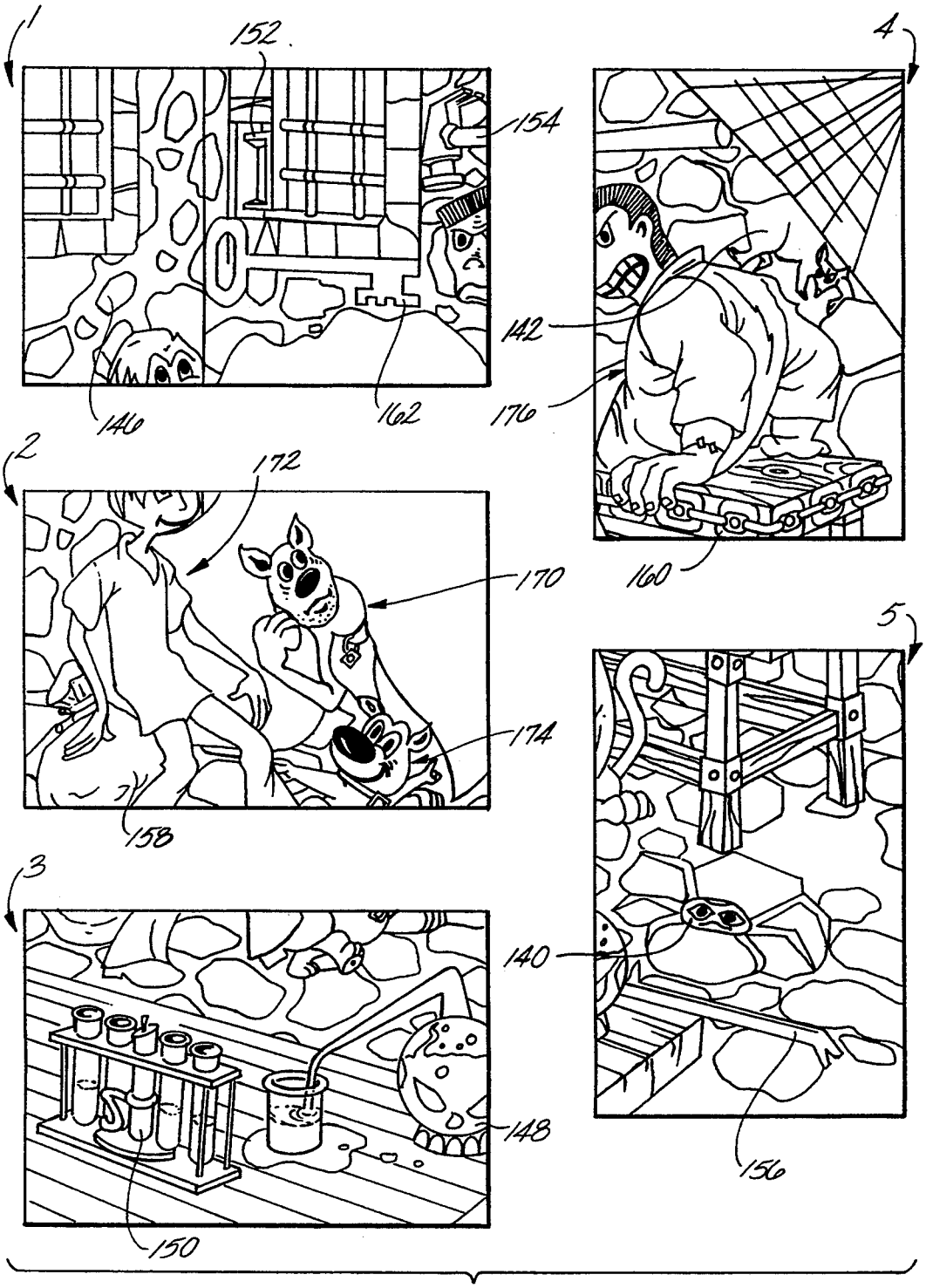
FIG. 1 is an exploded view of an illustration borne by the combined front faces of game cards according to principles of the invention.
Figure 2A:
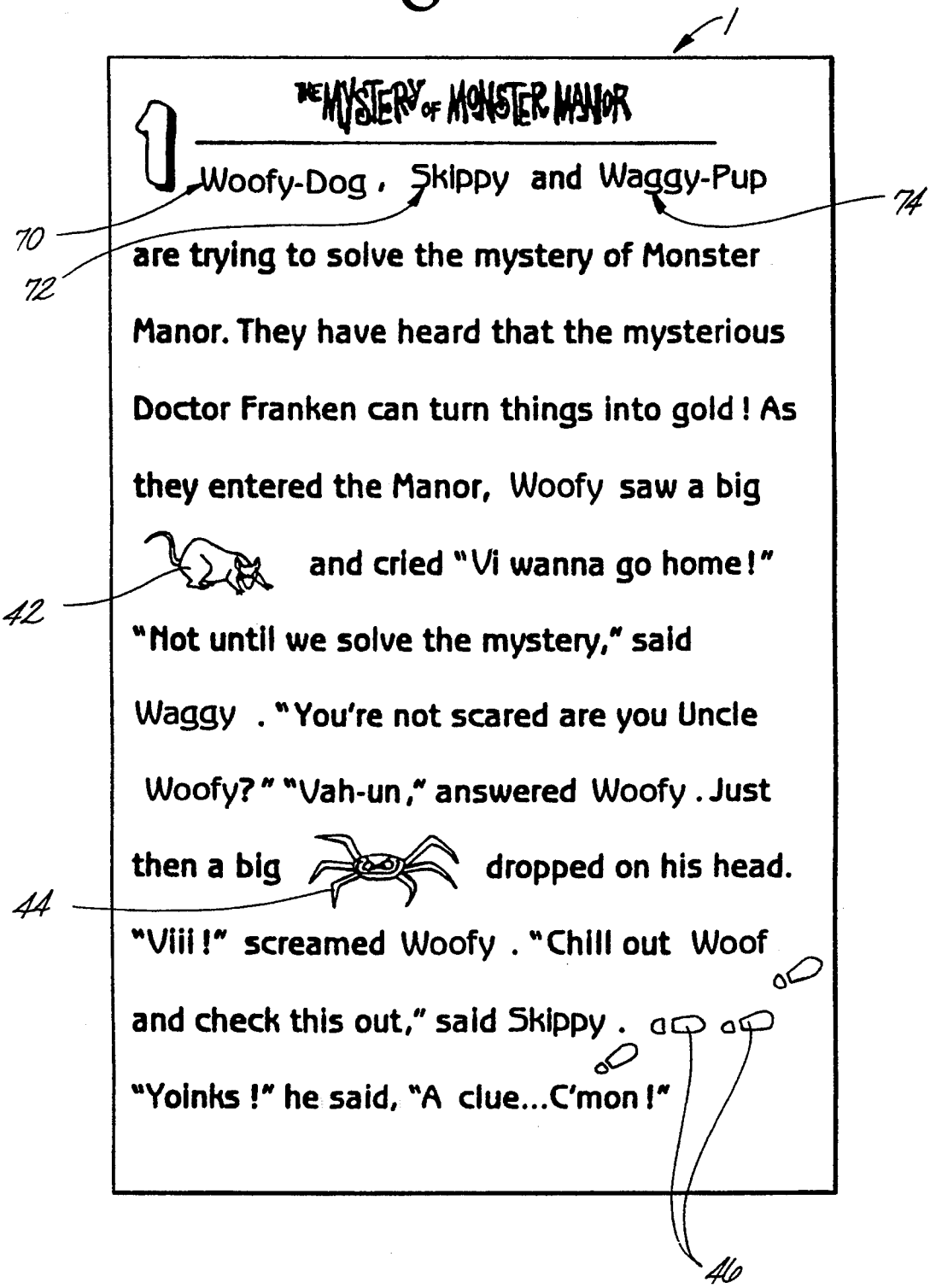
FIG. 2*a* is a view of the back face of a first game card according to principles of the invention with hidden elements shown revealed.

Another aspect of the puzzle is to assemble the game cards 1–5 so that their front faces form, in combination, an illustration of a scene pertaining to the story, as shown in FIG. 1. The illustration is in color, and may be printed using a standard four-color process. The illustration includes illustrations 170, 172, 174 and 176 of the various characters from the story. Additionally, the illustration includes artistically hidden (as opposed to chromatically camouflaged) illustrations 140, 142, 144, 146, 148, 150, 152, 154, 156, 158, 160 and 162 of the elements 40, 42, 44, 46, 48, 50, 52, 54, 56, 58, 60 and 62. After assembling the illustration, the user may endeavor to find the artistically hidden illustrations. Although possible, chromatic camouflaging of the elements within the illustration would drastically decrease the artistic quality and increase the effort required to prepare the illustration.

In the exemplary embodiment, the game cards 1–5 are formed of 12 point stock with an aqueous coating on both faces. Each card has a length of 3.75 inches and a width of 2.50 inches, for a ratio of length to width or "aspect ratio" of three to two. This permits a rectangular illustration to be formed by five cards.

The wrapper 7 forms a sealed envelope and is formed of an inner layer of 70 gauge metalized polypropylene and an outer layer of clear coextruded polypropylene film. Markings on the wrapper are formed by an intermediate layer of ink and include a simplified version 100 of the illustration of the scene from the story.

While the preferred embodiment of a game has been described and illustrated herein, many other constructions will be apparent to those skilled in the art. By way of example, surface treatment of the game cards could permit the use of a decoder card with a polarizer to achieve a similar effect. It is therefore to be understood that, within the scope of the appended claims, the invention may be practiced otherwise than is specifically described.

What is claimed is:

1. A game comprising:

a plurality of game cards, each having first and second faces; and a decoder comprising a chromatic filter, wherein at least one of said plurality of game cards bears a written story on its first face and wherein a plurality of elements of said story are obscured by chromatic camouflage such that their legibility is improved when viewed through said chromatic filter.

2. The game of claim 1 wherein said chromatic filter is a red filter and the chromatic camouflage comprises red markings on said first face of said at least one card.

3. The game of claim 1 wherein said plurality of elements are illustrations.

4. The game of claim 3 wherein said plurality of elements are clues to a mystery outlined in said story.

5. The game of claim 1 wherein one card of said plurality of cards is an answer card having printed on its first face an answer to the mystery.

6. The game of claim 5 wherein said one card has written on its first face a key to said plurality of elements.

7. The game of claim 1 wherein said second faces of the plurality of cards, in combination, bear an illustration of a scene pertaining to the story.

8. The game of claim 7 wherein said illustration contains illustrations of characters from the story.

9. The game of claim 8 wherein said illustration comprises hidden illustrations of said plurality of elements.

10. The game of claim 8 wherein each card of said plurality of cards is rectangular and has an aspect ratio of three to two.

11. The game of claim 1 wherein said decoder comprises an opaque first layer having a first window and an opaque second layer having a second window aligned with the first window, said chromatic filter secured between said first and second layers and spanning said first and second windows.

12. The game of claim 11 wherein said decoder has instructions for using the game imprinted on an outer surface of its first layer.

13. The game of claim 1 further comprising a polypropylene film wrapper containing said plurality of cards and decoder.

14. A game comprising:

a plurality of game cards, each having first and second faces; and a decoder comprising transparent sheet, wherein at least one of said plurality of game cards bears a written story on its first face and wherein a plurality of elements of said story are hidden such that their legibility is improved when viewed through said a colored transparent sheet.

15. A method for playing a card game comprising a plurality of story bearing cards, each with camouflaged elements in the story, and a decoder for reading the camouflaged elements, the cards each comprising a side opposite from the story, which in combination with the other cards forms an illustration of a scene, the method comprising the steps of:

reading the story on each card;

using the decoder to view and read the camouflaged elements of the story on each card; and assembling the cards together with their opposite sides exposed to form the scene.

* * * * *

UNITED STATES PATENT AND TRADEMARK OFFICE

CERTIFICATE OF CORRECTION

PATENT NO. : 5,401,032

DATED : March 28, 1995

INVENTOR(S) : Thomas L. Barnhart; Frank M. Smith

It is certified that error appears in the above-indentified patent and that said Letters Patent is hereby corrected as shown below:

On the title page, [73] Assignee, change
"Irvine, Calif." to
-- Irwindale, Calif. --.
Column 1, Line 7, change "disclosure" to
-- disclosures --.
Column 2, line 28, after "face of" delete "a".
Column 2, line 44, change "one-5" to -- 1-5 --.
Column 2, line 67, change "Du Pont Co" to
-- Du Pont Co. --.
Column 3, line 57, change "tying" to -- trying --.
Column 4, line 33, change "of" to -- off --.
Column 6, line 37, before "colored" delete "a".

Signed and Sealed this

Thirty-first Day of October 1995

*Attest:*

*Attesting Officer*

BRUCE LEHMAN

*Commissioner of Patents and Trademarks*